US005339789A

United States Patent [19]

Heitz

[11] Patent Number: 5,339,789

[45] Date of Patent: Aug. 23, 1994

[54] LOW-RECOIL FIREARM

[75] Inventor: Walter Heitz, Rastatt, Fed. Rep. of Germany

[73] Assignee: Mayer & Grammelspacher Dianawerk GmbH & Co KG, Rastatt, Fed. Rep. of Germany

[21] Appl. No.: 912,150

[22] Filed: Jul. 10, 1992

[30] Foreign Application Priority Data

Jul. 10, 1991 [DE] Fed. Rep. of Germany ..... 4122835

[51] Int. Cl.[5] ..... F41B 11/00

[52] U.S. Cl. ..... 124/56; 124/68; 42/1.06; 89/44.01; 89/177

[58] Field of Search ..... 124/27, 28, 29, 65, 124/66, 67, 68, 56; 42/1.06; 89/37.14, 40.01, 44.01, 177, 178

[56] References Cited

U.S. PATENT DOCUMENTS

| | | | |
|---|---|---|---|
| 1,520,343 | 12/1924 | Green | 89/37.14 X |
| 4,473,964 | 10/1984 | Straub et al. | 124/68 X |
| 4,850,328 | 7/1989 | Sindel | 124/67 |

FOREIGN PATENT DOCUMENTS

| | | | |
|---|---|---|---|
| 684718 | 12/1939 | Fed. Rep. of Germany | 89/37.14 |
| 717312 | 1/1942 | Fed. Rep. of Germany . | |
| 1857879 | 7/1962 | Fed. Rep. of Germany . | |
| 1140489 | 11/1962 | Fed. Rep. of Germany . | |
| 1150907 | 6/1963 | Fed. Rep. of Germany . | |
| 2329425 | 1/1975 | Fed. Rep. of Germany . | |
| 2512476 | 9/1976 | Fed. Rep. of Germany . | |
| 2936883 | 4/1981 | Fed. Rep. of Germany . | |
| 3111081 | 9/1982 | Fed. Rep. of Germany . | |
| 156785 | 11/1932 | Switzerland | 89/37.14 |
| 135384 | 12/1919 | United Kingdom . | |

OTHER PUBLICATIONS

"Ball-Behandling" by U. Eichstadt, *Visier*, Apr. 4, 1992, pp. 92–96.

*Primary Examiner*—Randolph A. Reese
*Assistant Examiner*—John Ricci
*Attorney, Agent, or Firm*—Brumbaugh, Graves, Donohue & Raymond

[57] ABSTRACT

A low-recoil gun (10), in particular a compressed-air gun or hand firearm, is proposed, comprising a stock assembly (25) and a barrel assembly (20) displaceable relative to the stock assembly (25) in the longitudinal direction (B) of the gun (10). The barrel assembly (20) can be moved contrary to the direction of fire (A), on the occasion of a discharge, out of a position of readiness to fire. The reverse travel of the barrel assembly (20) due to the discharge is restrained by an locking device (40) capable of being overcome by the recoil energy of the barrel assembly (20). In overcoming the locking device, the barrel assembly (20) performs work, which is deducted from the recoil energy, so that the recoil ultimately transmitted to the gunner is at least substantially reduced. In the gun according to the invention, the axial force required in longitudinal direction (B) of the barrel to overcome the locking device (40) is adjustable.

38 Claims, 8 Drawing Sheets

LOW-RECOIL FIREARM

DESCRIPTION

The invention relates to a gun, in particular to a compressed-air gun or a firearm, comprising a stock assembly and a barrel assembly displaceable relative to the stock assembly in longitudinal direction of the gun, the barrel assembly being movable out of a position of readiness to fire, contrary to the direction of firing, on the occasion of a discharge, and the barrel assembly's reverse motion due to the discharge being restrained by an arresting means capable of being overcome by the recoil energy of the barrel assembly.

Such a gun is disclosed for example in German Utility Design 1,857,879. In that gun, the barrel assembly is held in the position of readiness to fire by the arresting means even when the gun is held at an inclination to the horizontal. It is intended that upon actuation of the trigger, the gun is to overcome the arresting means by virtue of the recoil occurring at discharge. For to this end, the barrel assembly must perform work, i.e. expend energy, drawn from the recoil energy of the barrel assembly. Therefore the barrel assembly is enabled to transmit a correspondingly lesser recoil to the stock assembly and hence to the gunner. Theoretically, therefore, this is a low-recoil weapon, or even, in the ideal case, free from recoil.

In practice, however, it has been found that in the type of gun disclosed by GUD 1,857,879, the arresting means has been overcome with differing ease or difficulty from specimen to specimen because of manufacturing tolerances. As a result, owing to such manufacturing tolerances, these arms have not lent themselves to systematic low recoil or recoil-free manufacture. For if it was too difficult to overcome the arresting means, the barrel and stock assemblies were rigidly connected in practice, and the recoil was transmitted to the gunner undiminished. On the other hand, if the arresting means was too easily overcome, energy was not consumed in sufficient degree, and the recoil was transmitted to the gunner substantially undiminished when a stop limiting the displacement travel was encountered. According to the foregoing, freedom from recoil, or low recoil, were not afforded by this known gun.

The object of the invention, by contrast, is to provide a gun of the kind initially described in which freedom from recoil, or low recoil, can be dependably achieved.

This object is accomplished in that the required axial force in longitudinal direction of the barrel to overcome the arresting means, particularly the initial force in longitudinal direction of the barrel, is adjustable. It has been found that the amount of energy withdrawn from the recoil in overcoming the arresting means depends on the form of arrest, the component of force in longitudinal direction of the barrel counteracting the disengagement of the arresting member, and the like. By virtue of the preferably continuous adjustability, according to the invention, of the value of the axial force in longitudinal direction of the barrel, deviations in the form of arrest and other parameters affecting the amount of energy absorbed from a corresponding desired norm can be compensated. Therefore a predetermined optimal amount of energy can be consistently withdrawn from the recoil energy, ensuring that upon discharge, the arresting means can be dependably, but on the other hand not too easily overcome. In this way, the desired low-recoil or recoil-free character of the gun can always be dependably achieved.

The guns according to the invention may be adjusted for optimal recoil behavior at factory, by the dealer, or alternatively by a gunner skilled in the art. Ordinarily, the adjustment of the arresting means to optimal recoil behavior will be fixed, for example by sealing the arresting means. Upon modification of the gun, for example due to age or to replacement of parts for repair, such as the spring in a gas pressure gun, and a resulting change in recoil behavior, the fixation may be undone at any time and the arresting means readjusted to optimal recoil behavior.

In the adjustment of the arresting means, much depends especially on the adjustability of the initial force required to overcome the arresting means. This force is in fact of the greatest importance for recoil behavior, for one reason because the initial force of friction is always greater than that of a motion once initiated.

So that the arresting means may be employed also to fix the gun in the position of readiness to fire, it is proposed that the arresting means take effect approximately at and preferably immediately upon commencement of the reverse travel of the barrel assembly out of the position of readiness to fire. Accordingly, the barrel assembly is not braked down to overcome the arresting means after the reverse motion has already started, but overcomes the latter before the actual reverse motion begins, thus providing a smooth action.

A simple construction of the arresting means may be achieved by configuring the arresting means with at least one detent adjustable against spring action in one of the assemblies, which detent is capable of being disengaged against spring action by a disengaging surface or edge arranged on the other assembly, upon reverse motion of the barrel assembly. The work performed against spring action by the surface or edge in disengaging the detent is taken in the form of energy from the recoil energy of the barrel assembly. Preferably, the axial force required in longitudinal direction of the barrel to overcome the arresting means is adjustable by varying the force of the spring action.

To permit access to the arresting means in simple manner, for example for readjustment, it is proposed that the detent be arranged on the stock assembly.

The recoil energy of the barrel assembly can perform the work of disengagement with especial effectiveness if the detent is guided on a disengagement path in the assembly in question having a directional component perpendicular to the barrel centerline. Preferably the path of disengagement extends substantially perpendicular to the centerline of the barrel.

In conventional guns, the path of disengagement may be provided in simple manner in that the detent is disengageable downward, in terms of the shape of the gun, by the disengaging surface or edge upon reverse motion of the barrel assembly. Instead, however, the detent might be laterally disengageable, in terms of the shape of the gun, by the disengaging surface or edge, upon reverse motion of the barrel assembly.

For the sake of utmost uniformity of distribution of work performed per unit reverse travel along the reverse travel of the barrel assembly, it is provided that the disengaging surface or edge and an engagement surface of the detent cooperating with said surface or edge be geometrically so coordinated with each other that with increasing reverse travel of the barrel assembly, the disengaging travel of the detent increases degressively. Ordinarily, the spring action will increase with increasing disengagement travel. Owing to the degressive increase of the disengagement travel, however, the rate of change of the disengagement travel decreases as the reverse travel progresses, so that the amounts of work performed in equal segments of reverse travel, i.e. the products of the spring force corresponding to the given engagement travel by the increment of disengagement travel produced on the segment of reverse travel in question, will at least not increase so sharply as it would in the case of a proportional, let alone progressive increase in disengagement travel. In this way it is possible substantially to adapt the work of disengagement performed at a given point in time to the recoil occurring at that point in time.

A disengagement travel increasing degressively with increasing reverse travel can be provided in simple manner in that the detent possesses an engagement surface having an approximately circular line of engagement, preferably a spherical engagement surface.

With a path of disengagement substantially perpendicular to the direction of the barrel, a detent having an approximately circular line of engagement can be disengaged the more readily from the engaging surface or edge, the smaller the angle included between the line connecting the point of engagement and the center of curvature of the line of engagement, and the direction of the path of disengagement. On the other hand, energy can be withdrawn from the recoil energy of the barrel assembly the more effectively, the greater that angle. A good compromise between these competing effects can be struck by choosing an angle between 30° and 80°, preferably between 45° and 70°.

In order to brake down the reverse travel of the barrel assembly after overcoming the arrest, and thus gradually cushion any remaining recoil, it is proposed that an oblique ramp surface be provided on the other assembly, tilted about the transverse axis of the gun by a predetermined angle relative to a plane determined by the longitudinal and transverse axes of the gun, the detent being increasingly disengageable against spring action by the oblique ramp surface in the course of the reverse motion of the barrel assembly.

If a damping member is provided near the end of the reverse travel of the barrel assembly to damp the reverse motion of the barrel assembly, it is possible to prevent any residual recoil remaining at the end of the reverse travel from being transmitted abruptly to the gunner.

A desired recoil behavior of the gun can be achieved by adapting the mass of the detent and optionally of parts connected to the detent for common action, and/or of the spring force. To overcome the arresting means, the mass of the detent must be accelerated. The greater the mass of the detent, the more sluggishly the arresting means will be overcome. The recoil behavior of the gun can thus be influenced at will by changing the mass of the detent.

In order to provide a displaceability of the barrel assembly in longitudinal direction of the gun relative to the stock assembly in a simple manner, it is proposed that the barrel assembly be guided on the stock assembly by a slide bearing guide.

A secure guidance of the barrel assembly in a plane can be achieved by configuring the slide bearing guide in the manner of a three-point bearing consisting of a twin-bearing guide and a single-bearing guide distance therefrom in the direction of the centerline of the barrel. In the vicinity of the single-bearing guide, a supplementary torsion-securing guide may be provided by means of supporting elements, in particular supporting balls, elastically prestressed against a guiding surface.

The arresting means may be integrated with the slide bearing guides in simple manner in that the arrest is arranged between a guide block of the slide bearing guide and the support of a guide element guiding the guide block.

For dependable prevention of occurrence of torques acting on the gun, it is proposed that the centerlines of all three bearings of the twin-bearing guide and single-bearing guide lie substantially in a plane.

In a preferred embodiment, the slide bearing guide may be in the form of a slide pin guide comprising a double-pin guide and a single-pin guide distanced therefrom in the direction of the centerline of the barrel. In principle, however, conceivably the twin-bearing guide may comprise a guide plate guided in an undercut guidance groove.

The invention will now be illustrated in more detail in terms of an embodiment with reference to the drawing by way of example. In the drawing, FIG. 1 shows a side view of a compressed-air gun with arresting means according to the invention, in home position;

Figure 7:
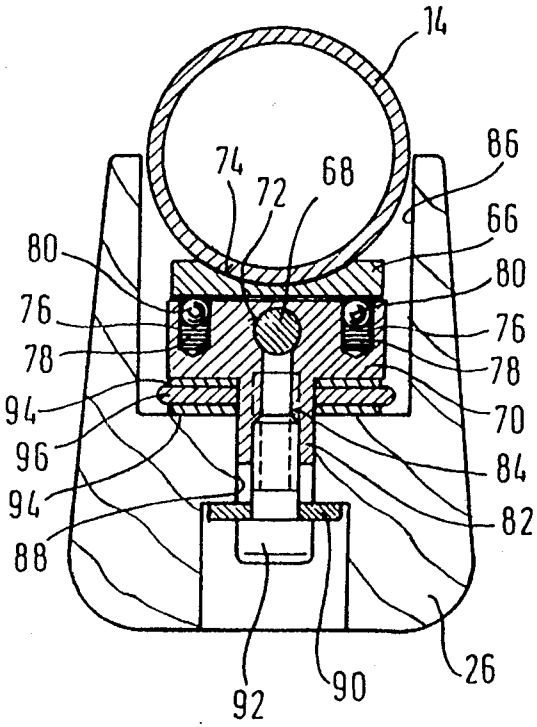
FIG. 7 shows a sectional view at the line VII—VII in FIG. 1.
Figure 5:
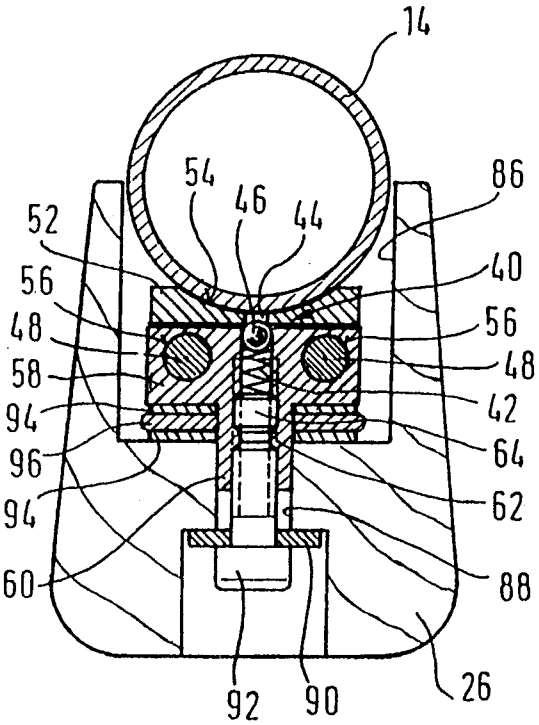
FIG. 5 shows a sectional view at the line V—V in FIG. 3.
Figures 9A, 9B:
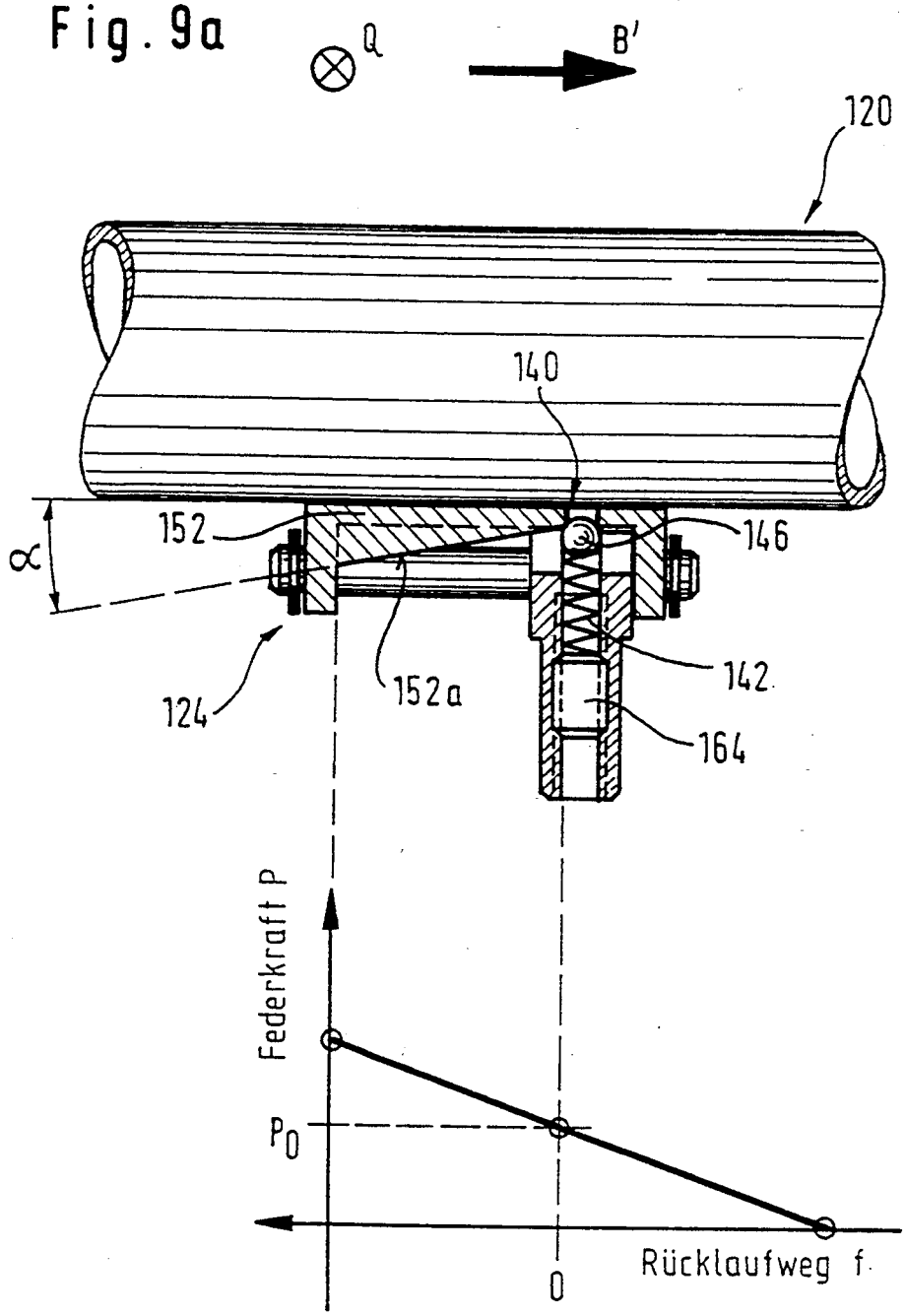
Figure 10:
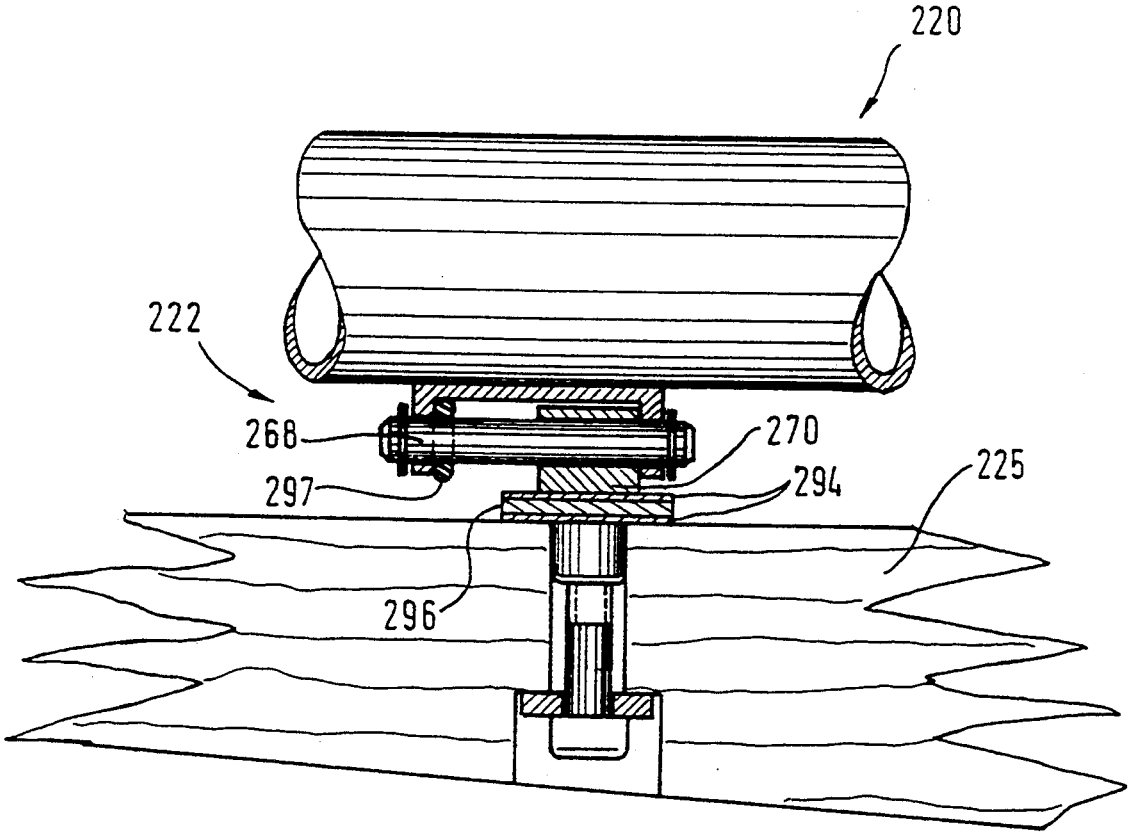
Figure 11:
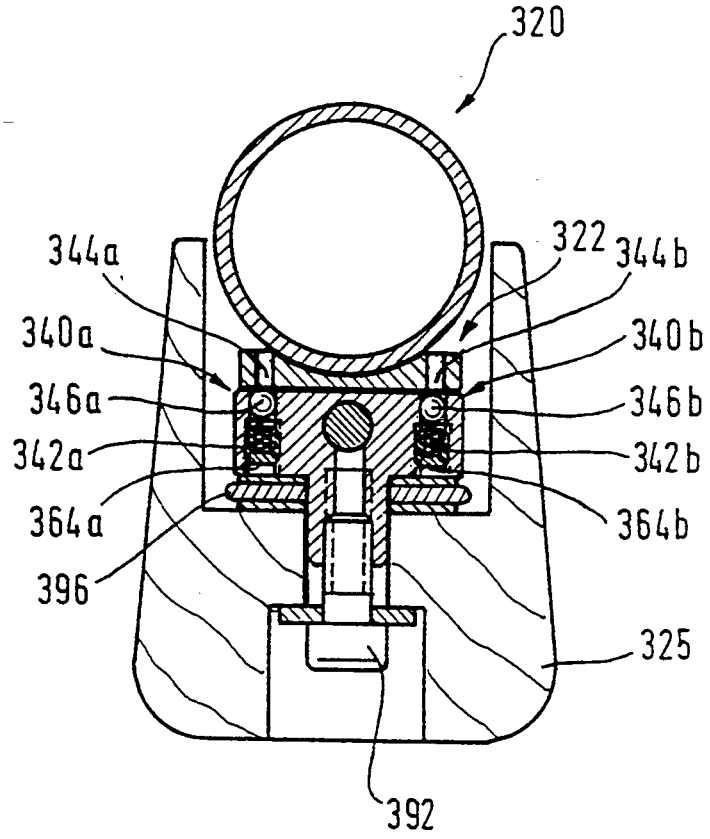
Figure 12:
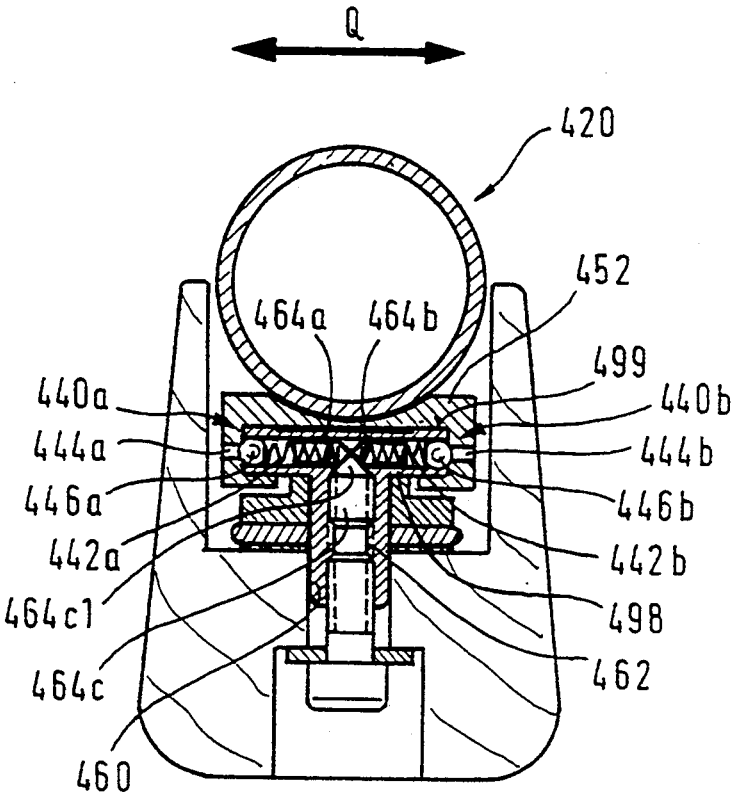

FIG. 9*a* shows a sectional side view of another embodiment of a mount having an arresting means according to the invention, to a larger scale;

FIG. 9*b* shows a force-displacement diagram representing the spring force of the arresting means according to FIG. 9*a* as a function of the reverse travel of the barrel assembly;

FIG. 10 shows a view, similar to FIG. 9*a*, of another embodiment of a mount;

FIG. 11 shows a view, similar to FIG. 7, of another embodiment of a mount with arresting means according to the invention; and, FIG. 12 shows a view, similar to FIG. 5, of a mount with arresting means according to the invention.

Figure 1:
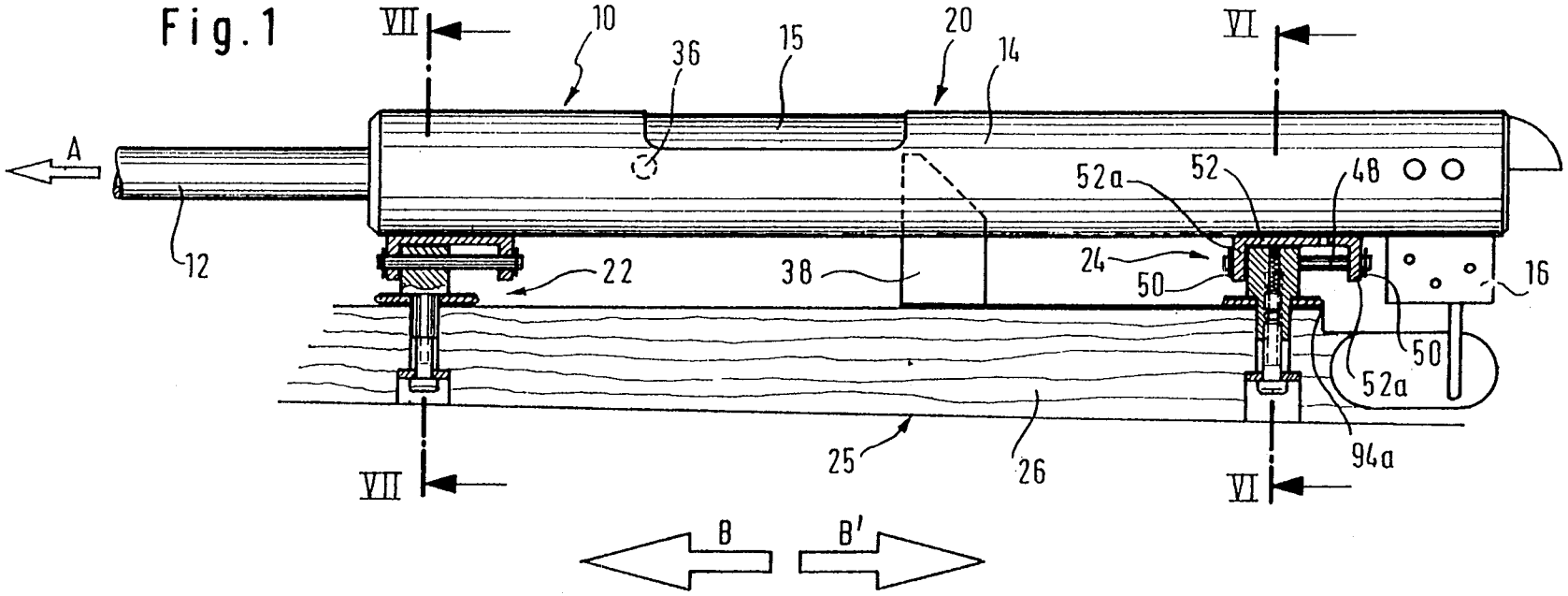

FIG. 1 represents a compressed-air gun, designated 10 in the following. A barrel 12 of the compressed-air gun 10 is fixed to a jacketing cylinder 14. The jacketing cylinder 14 accommodates, in addition to a slide cylinder 15, the air piston and pressure piston spring, parts not shown, of the compressed-air gun. At the end of the jacketing cylinder 14 away from the barrel, a trigger system 16 is arranged.

Figure 2:
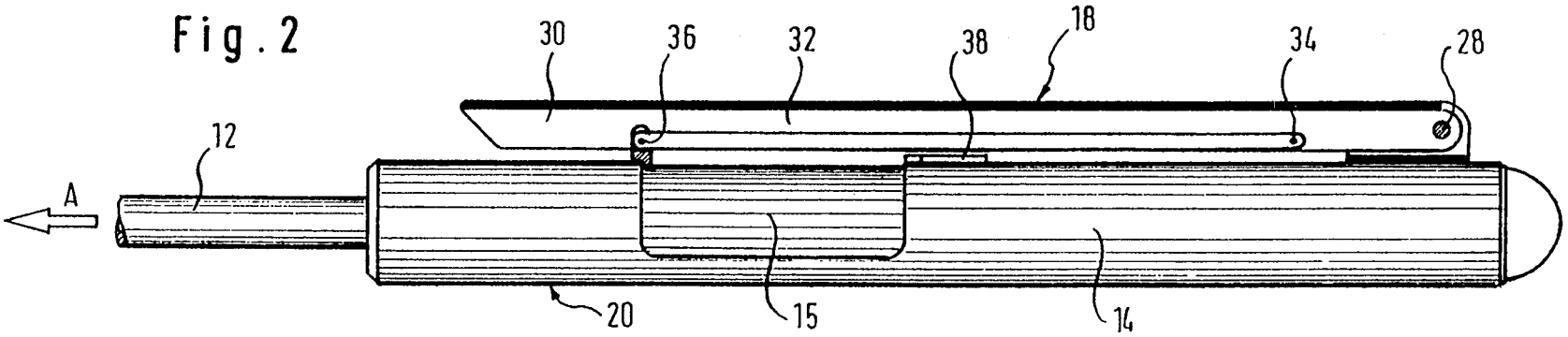
FIG. 2 shows a top view of the compressed-air gun of FIG. 1.

For cocking the compressed-air gun 10, a cocking lever linkage 18 (see FIGS. 2 and 4) is arranged at the right of the compressed-air gun 10, as viewed in the direction of fire A. The jacketing cylinder 14 is mounted displaceable in the direction of the arrows B and B', substantially parallel to the direction of fire A, on two mounts 22 and 24 on a stock 26 between a position of readiness to fire (see FIG. 3) and a home position (see FIG. 1). The mount 22 near the muzzle is configured with a single slide bearing and (cf. FIG. 7) comprises a pin bearing 66, a slide pin guide 70 and a slide pin 68. The mount 24 away from the muzzle is configured with a twin-slide bearing and comprises (cf. FIGS. 5 and 6) a pin bearing 52, a slide pin guide 58 and two slide pins 48.

The barrel 12, the jacketing cylinder 14 with parts accommodated therein, the trigger system 16, the cocking lever linkage 18 as well as the pin bearing 66 and 52 and the slide pins 68 and 48 of the mounts 22 and 24 form a barrel assembly 20. The stock 26 and the slide pin guides 70 and 58 of mounts 22 and 24 form a stock assembly 25.

The cocking lever linkage 18 comprises a cocking lever 30 (FIGS. 2 and 4) swingably articulated at 28 to the jacketing cylinder 14. A tension rod 32 is swingably linked at one end to the cocking lever 30 at 34 and at the other end to an articulating projection 36 provided on the slide cylinder 15. To cock the compressed-air gun 10, the lever 10 is swung clockwise in the top view of FIG. 2 about its point of articulation 28 (cf. FIG. 4) out of its rest position shown in FIG. 2. The swinging motion is transmitted to the slide cylinder 15 by way of the tension rod 32. This at first displaces the slide cylinder 15 against the force of the pressure piston spring in the direction of the arrow B', while the barrel assembly 20 remains in its home position relative to the stock 26 as in FIG. 1. The displacement travel of the slide cylinder 15 relative to the stock 26 is limited by a transport angle 38, fixed to the stock 26 for the articulating projection 36 of the slide cylinder 15. If the articulating projection 36 is in contact with the transport angle 38, then upon further swinging of the cocking lever 30 clockwise, the barrel assembly 20 will be displaced out of home position (FIG. 1) in the direction of the arrow B until it arrives in its position of readiness for firing as in FIG. 3.

The barrel assembly 20 is fixed in position of readiness to fire relative to the stock assembly 25 by an arresting means 40. In principle, various embodiments of the arresting means are conceivable. Thus the arresting effect might for example comprise a segment with high coefficient of friction on one of the mounts 22, 24 near the readiness position of the barrel assembly 20. In the preferred embodiment of the invention, however, the arresting means comprises at least one ball catch (see for example the ball catch 40 in FIGS. 5 and 6), each ball catch comprising an arrest ball prestressed into a recess by a helical compression spring (see for example FIG. 5) in the position of readiness, and being arranged in one of the mounts 22 and 24 (see FIGS. 1 and 3).

Figure 6:
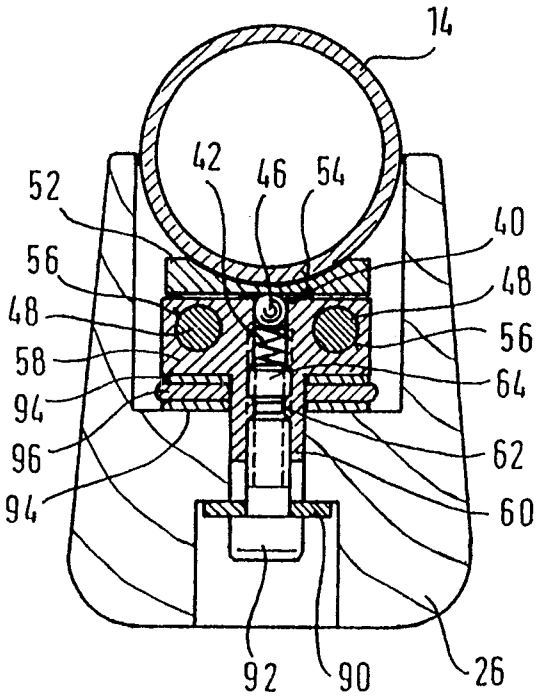
FIG. 6 shows a sectional view at the line VI—VI in FIG. 1.

FIGS. 5 and 6 show a first embodiment of such an arresting means by way of example. This arresting means comprises a single ball catch 40 with arrest ball 46 prestressed into a recess 44 by a helical compression spring 42. The ball catch 40 is arranged in the mount 24.

By the arresting means 40, the barrel assembly 20 is kept in the position of readiness relative to the stock 26 even when the compressed-air gun 10 is held at an inclination relative to the horizontal, or even when it is held vertical. The arresting means 40 can be overcome by the recoil energy of the barrel assembly 20 on the occasion of a discharge, requiring work to be performed by the barrel assembly 20. The energy required to perform this work is drawn from the recoil energy. If the recoil energy has not been entirely consumed in overcoming the arresting means 40, the barrel assembly 20 will be moved in the direction of the arrow B' towards the home position by the remaining recoil energy, and when it reaches the home position, the recoil energy then remaining will be transmitted to the stock 26. A gunner holding the stock 26 will experience a distinctly smaller impact due to recoil than would correspond to the full recoil of the discharge, since an appreciable portion of the recoil energy will have been absorbed in overcoming the arresting means 40.

The mounts 22 and 24, arranged at a distance from each other in the direction of fire A, are in the form of slide pin guides and suspend the barrel assembly 20 in the manner of a three-point support on the stock 26. This affords a more secure lodgment of the barrel assembly 20 in a plane, without at the same time calling for very close manufacturing tolerances. The mount 24 accommodating the ball catch is arranged near the trigger system 16, that is, at the end of the jacketing cylinder 14 away from the barrel, ahead of the trigger system 16. The mount 22 is arranged at the end of the jacketing cylinder 14 near the barrel.

The mount 24 is in the form of a double-pin guide (cf. FIGS. 5 and 6). The slide pins 48 of the mount 24 are lodged in holes 50 (see FIGS. 1 and 3) provided in lateral portions **52*a* of the pin bearing 52 extending downwards at a distance from each other in the direction of fire A. A base portion 52*b* connecting the two lateral portions 52*a* of the pin bearing 52 has a depression 54 in the shape of a portion of a cylinder and extending in the direction of fire A on the side towards the jacketing cylinder 14, the radius of curvature of which depression is substantially equal to half the outside diameter of the jacketing cylinder 14. The depression 54 of the pin bearing 52 is placed on the jacketing cylinder 14, so that the pin bearing 52 is oriented in longitudinal direction of the jacketing cylinder 14**, and is permanently attached thereto by welding.

The slide pins 48 are guided in holes 56 of the slide pin guide 58. On the side of the slide pin guide 58 away from the pin bearing 52, a shank 60 is provided, serving to connect the slide pin guide 58 to the stock 26. The shank 60 has a central bore 62 extending all the way to the side of the slide pin guide 58 facing the pin bearing 52 and provided with an internal thread. The arrest ball 46 and the spring 42 are inserted in the hole 62. The spring 42 abuts at one end on an adjusting screw screwed into the threaded hole 62 and at the other end on the arrest ball 46, which it prestresses against the pin bearing 52. In the position of readiness shown in FIG. 5, the ball 46 catches in the recess 44 provided in the pin bearing 52.

By means of the adjusting screw 64, the prestress of the compression spring 42 can be adjusted continuously. For given disengagement travel of the arrest ball 44, this enables the gunner to adjust the energy absorbed by the arresting means 40 in the reverse travel of the barrel assembly 20 to a desired value. Ordinarily, the prestress of the spring 42 will have been preadjusted to a suitable value by the manufacturer of the compressed-air gun.

For the readjustability of the arresting means 40, it is of critical importance further that the adjusting screw 64 be in the first place relatively accessible, but in the second place not liable to be turned unintentionally in operation of the gun. For this purpose, after adjustment of the adjusting means 40, the adjusting screw 64 is shielded by a stock fastening screw 92.

To preadjust the gun, an operator at the factory, a gunsmith or possibly the skilled gunner himself need only free the fastening screw 92, and then has access, for example with a wrench, to the adjusting screw 64. Then he can adjust the screw 64 according to the following program for example:

If it turns out that the arrest has indeed been overcome, yet the gun delivers an impact due to the recoil, this means that the force required to overcome the arrest 40 must be increased, that is, the adjusting screw 64 must be tightened.

The tightening of the adjusting screw 64 is continued, in several stages if necessary, until the gun delivers no perceptible impact. Then any additional tightening is not advisable, since if the adjustment is too hard, an impact is again to be expected, because the gun will then behave as though the barrel assembly 20 and the stock assembly 25 were rigidly connected. In this latter case, the adjusting screw 64 should be loosened again, little by little.

Figure 8:
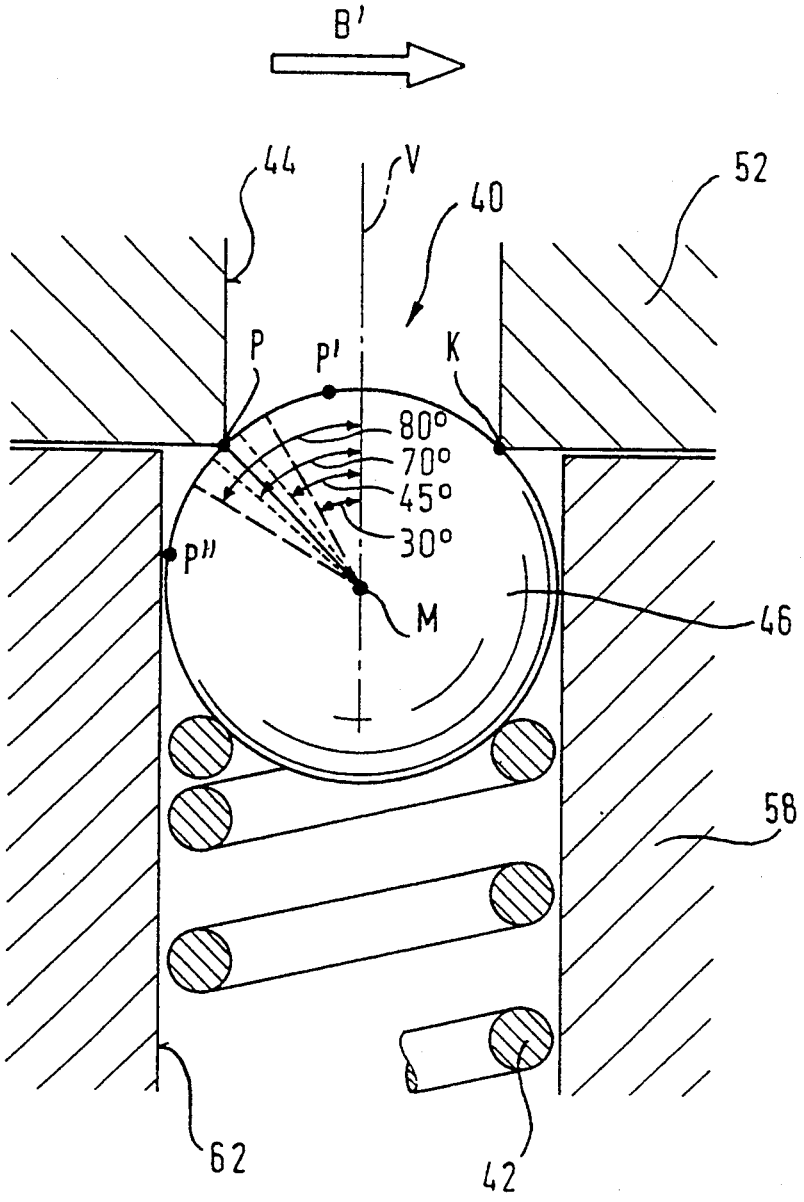
FIG. 8 shows a schematic diagram to illustrate the cooperation of detent and disengagement surface or edge.

FIG. 8 shows the arresting means 40 to a larger scale, with arrest ball 46 lodged in the recess 44. The ball 46 is prestressed by the spring 42 against the edge K of the recess 44. If the pin bearing 52 is moved in the direction of the arrow B' in the course of the reverse travel of the barrel assembly 20, the edge K will act as a disengaging edge in the vicinity of a point of engagement P between pin bearing 52 and ball 46. The path of disengagement determined by the hole 62 is substantially perpendicular to the direction B'.

Were the disengaging edge to act on the arrest ball 46 in the neighborhood of the point P' at the beginning of the reverse motion of the barrel assembly 20, the ball could indeed be disengaged easily, but only a small amount of energy could be transmitted to the spring 42. On the other hand, if the disengaging edge were to act on the ball in the vicinity of the point P'', while a large amount of energy could be transmitted to the spring 42, the ball 46 could be disengaged only with great difficulty. In order to disengage the ball 46 easily yet transmit a large amount of energy to the spring 42, the angle included at the beginning of engagement with the ball 46 by the line connecting the point P with the center M of the ball and the vertical V, i.e. the direction of the disengagement path, is taken between 30° and 80°, preferably between 45° and 70°.

According to the invention, instead of the arrest ball 46, an arrest pin with head in the shape of a portion of a cylinder may for example be provided, engaging an oblong hole in the pin bearing, extending parallel to the centerline of the cylinder.

The mount 22 is in the form of a single-pin guide (cf. FIG. 7), and, like the mount 24, comprises a pin bearing 66, a slide pin 68 supported by it, whose centerline extends substantially in the direction of fire A, and the slide pin guide 70 with hole 72 in which the slide pin 68 is guided. The pin bearing 66 is fitted to the jacketing cylinder 14 by a depression 74 in the shape of a portion of a cylinder, its radius of curvature matching the jacketing cylinder 14, and oriented in longitudinal direction of the jacketing cylinder 14. The pin bearing 66 is fixed to the jacketing cylinder 14 by welding.

In the slide pin guide 70, on either side of the slide pin hole 72 as viewed in the direction of fire A, a blind hole 76 is arranged, open towards the side of the slide pin guide 70 facing the pin bearing 66. In each of these blind holes 76, a helical compressive spring 78 and a ball 80 are accommodated, together providing additional guidance for the pin bearing 66. The springs 78 prestress the balls 80 against the pin bearing 66, so that the gun is oriented in horizontal position and a spontaneous tilt about the longitudinal axis of the gun is precluded. Upon displacement of the barrel assembly 20 relative to the stock 26, these additional guides 78/80 generate some friction between barrel assembly 20 and stock 26.

On the side of the pin bearing 66 away from the slide pin guide 70, a shank 82 is arranged, serving to connect the slide pin guide 70 to the stock 26. For this purpose, the shank 60 has a central bore 84 provided with an internal thread.

Figure 3:
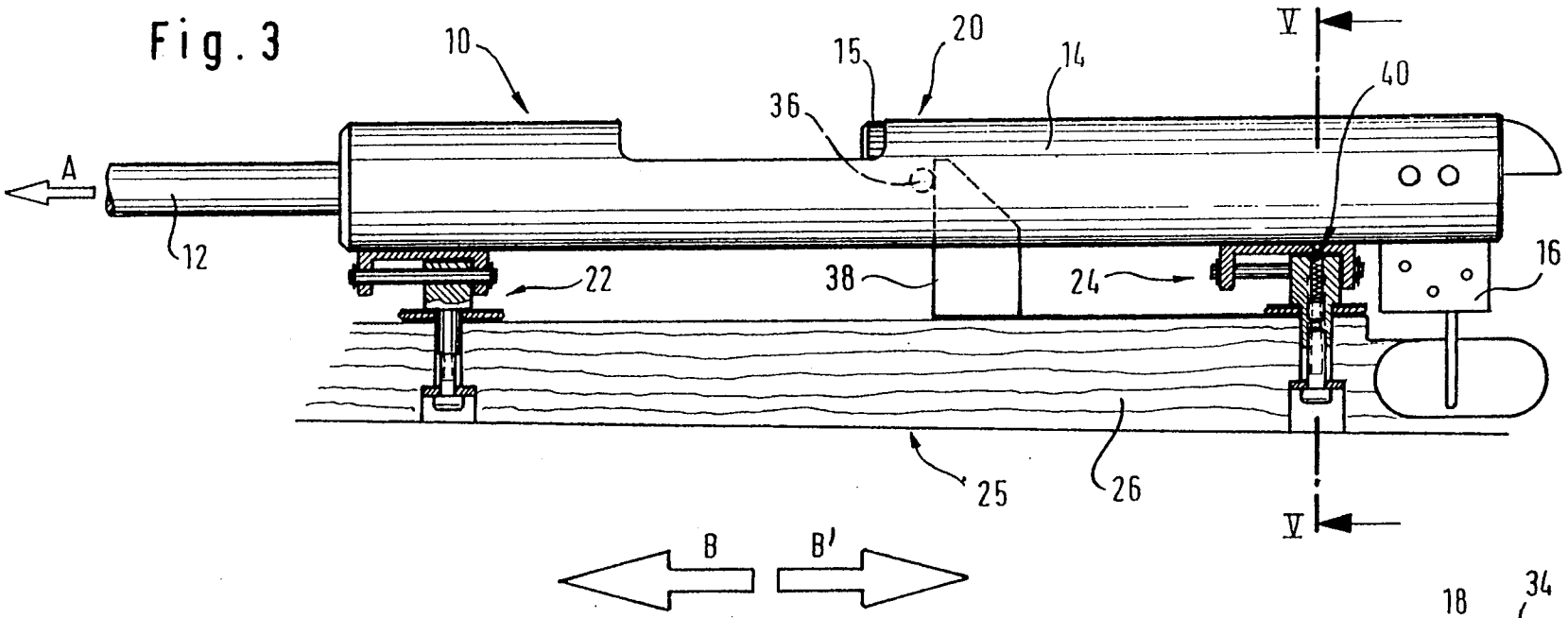
FIG. 3 shows a view similar to FIG. 1, but with the barrel assembly in position of readiness to fire.
Figure 4:
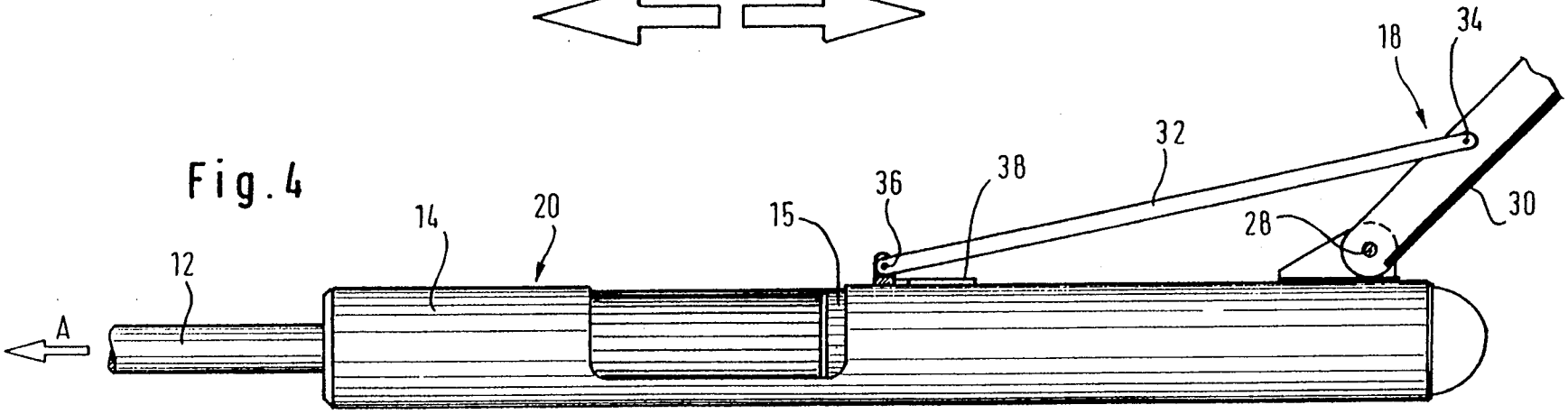
FIG. 4 shows a view similar to FIG. 2, but with cocking lever extended to cock the gun.

The jacketing cylinder 14 and the mounts 22 and 24 are accommodated in a cavity 86 of rectangular cross section machined inside the stock 26. The shanks 60 and 82 of the slide pin guides 58 and 70 respectively engage holes 88 provided in the stock 26 and are screw-assembled from beneath the stock 26 by means of fastening screws 92 with interposition of washers 90. The fastening screw 92 provided on mount 24 also shuts off access to the adjusting screw 64, protecting it from unauthorized interference. Between the under side of the slide pin guides 58, 70 and the bottom of the stock cavity 86, a cushion washer 96 is provided, in each instance interposed between two washers 94. The cushion washers 96 consist of a material having rubber elasticity, and afford a continuous adjustment of elevation in the attachment of the barrel assembly 20 to the stock 26. Also, the impacts generated upon discharge are at least partially damped by the cushion washers 96. As shown in FIGS. 1 and 3, the interlay **94*a* between cushion washer 96 and stock 26 at the posterior mount 24 is in one piece with the transport angle 38, so that the latter is attached to the stock 26 together with the mount 24**.

FIG. **9*a* shows a sectional view of another embodiment of a mount with arresting means to a larger scale, essentially resembling the mount shown in FIGS. 1, 3, 5 and 6. Corresponding parts are therefore assigned the same reference numerals as in those figures, but augmented by the number 100. The embodiment of FIG. 9*a*** will be described in the following only insofar as it differs from the embodiment previously described. In other respects, the reader is referred to the description of the latter.

The mount 124 differs from the mount 24 essentially in that the pin bearing 152 is provided with an incline **152*a* in one piece therewith, along which the arrest ball 146 rolls during reverse motion of the barrel assembly 120 in the direction of the arrow B'. As a result, the spring 142, after overcoming the arrest 140, is wound increasingly during the reverse travel of the barrel assembly 120, therefore pressing the arrest ball 146 against the incline 152*a* with increasing firmness. This leads to an increasing braking effect on the barrel assembly 120** with increasing reverse travel.

The inclined ramp **152*a* is tilted by an angle $\alpha$ about the transverse axis Q of the gun relative to a plane determined by the longitudinal axis (parallel in FIG. 9*a* to the reverse direction B') and the transverse axis Q (perpendicular in FIG. 9*a*** to the plane of the drawing, and marked by a crossed circle).

In FIG. **9*b*, the force P of the spring 142 is plotted against the reverse travel f of the barrel assembly 120, an increasing reverse travel being measured to the left on the axis of abscissas from an origin O representing the state of arrest. As in the embodiment previously described, in particular according to FIGS. 5 and 6, the prestress $P_0$ of the spring 142 in the state of arrest, i.e. at 0 reverse travel, can be adjusted by means of the screw 164**.

FIG. 10 shows a sectional view of another embodiment of a mount to a larger scale, essentially resembling the mounts shown in FIGS. 1 to 7. Corresponding parts are therefore assigned the same reference numerals as in those figures, but increased by the number 200. The embodiment of FIG. 10 will be described in the following only insofar as it differs from the embodiments previously described, to which description reference is here made in other respects.

The embodiment of FIG. 10 will be described in the following in terms of the mount 222, configured as a single-pin guide. The slide pin 268 is provided in the terminal portion of the reverse travel of the barrel assembly 220 with a damping member 297, which may for example consist of a rubber ring or the like. The function of this damping member 297 is to cushion the guide block 270 in case of any residual recoil and damp its impact, so that the recoil will not be abruptly transmitted to the gunner.

Although in the present embodiment, by way of example, the damping member 297 is arranged in the region of the single-pin guide, such damping members may alternatively be provided in the region of the double-pin guide. In principle, damping members of non-annular configuration might be used instead. However, annular damping members are distinguished by an especially high security against loss, since they can be installed encircling the slide pins.

FIG. 11 shows a view, similar to FIG. 5, of another embodiment of a muzzle mount, essentially resembling the muzzle mount shown in FIG. 7. Corresponding parts are therefore assigned the same reference numerals as in FIG. 7, but augmented by the number 300. The embodiment according to FIG. 11 will be described in the following only insofar as it differs from the embodiments previously described, to which description reference is here made in other respects.

The mount 322, in the form of a single-pin guide, is provided with a symmetrically arranged twin-ball catch 340*a*/340*b* as arresting means, in addition to the single-ball catch in the posterior mount (not shown). Here it is to be observed that the twin-ball catch and the single-ball catch are coordinated with each other so as to take effect simultaneously. The two ball catches 340*a* and 340*b* in the present embodiment by way of example are alike in configuration and comprise arrest balls 346*a* and 346*b* prestressed by springs 342*a* and 342*b* in recesses 344*a* and 344*b* respectively. The prestress of the springs 342*a* and 342*b* can be adjusted by means of sleeves 364*a* and 364*b* in the shape of adjusting screws.

In this embodiment by way of example, the adjusting sleeves 364*a* and 364*b* are not so readily accessible as the adjusting screw 64 of the embodiment according to FIG. 7 by way of example. Therefore, for example, by means of the ball catches 340*a* and 340*b* in the muzzle mount 322, a rough adjustment of the gun may be performed, requiring practically no further change thereafter, and the fine adjustment can be made using the single ball catch in the posterior mount.

It is to be noted further that the damping disk 396, like the damping disks in the embodiments previously described by way of example, also serves, besides damping, for leveling the barrel assembly 320 in the stock assembly 325 by drawing up the fastening screws 392 more or less tight, and at the same time to secure the fastening screws 392 against being loosened unintentionally.

FIG. 12 shows a view, similar to FIG. 5, of still another embodiment of a mount with twin slide bearing. Corresponding parts are assigned the same reference numerals as in FIGS. 1 to 6, but augmented by the number 400. The embodiment according to FIG. 12 will be described in the following only insofar as it differs from the embodiments previously described, to which description reference is here made in other respects.

In the first place, in the embodiment of FIG. 12 the twin slide bearing is not a slide pin bearing, but comprises a guide plate 498 on the stock assembly side, guided in an undercut guide groove 499 of the plate 452. In the second place, a twin ball catch 440*a*/440*b* is provided, whose members are guided in the guide plate 498 substantially in the transverse direction Q of the gun.

The two ball catches 440*a* and 440*b* in the present embodiment by way of example are of like configuration and comprise arrest balls 446*a* and 446*b* prestressed by springs 442*a* and 442*b* in recesses 444*a* and 444*b* respectively. The springs 442*a* and 442*b* are accommodated by their ends away from the balls 446*a* and 446*b* in sleeve-like prestress members 464*a* and 464*b* respectively, tapering conically at their closed ends.

The threaded hole 462 made in the shank 460 opens into the guide passage for the ball catches 440*a* and 440*b*. In the threaded hole 462, an adjusting screw 446*c* is arranged, having a conical tip 464*cl*. This conical tip 464*cl*, in adjusting the prestress of the ball catches 440*a* and 440*b*, acts upon the conical tips of the prestress sleeve 464*a* and 464*b*. In this way, a perfectly symmetrical situation can be created, as is important for the performance of the gun.

Although in the foregoing embodiments the single slide bearing has always been arranged in the muzzle mount and the twin slide bearing in the posterior mount, conceivably in principle the single slide bearing could be arranged in the posterior mount and the twin slide bearing in the muzzle mount. In choosing materials for the slide bearing, attention should be paid especially to good lubricity as well as good corrosion resistance to cold seawater, industrial waste water, acids, salt and alkalis.

According to the foregoing, it is likewise possible to arrange the ball catch or catches, as the particular requirement of the type of gun may dictate, in the posterior or/and the muzzle mount. Especially in the case of heavy weapons, as for example fire arms, it may be advantageous to provide arrests in both mounts.

The arrangement of the slide cylinder 15 in the jacketing cylinder 14 is known per se. It will here suffice to state the following.

When the slide cylinder 15 is pushed back relative to the jacketing cylinder 14, that is, when the slide cylinder 15 is being displaced out of the position of FIG. 1 into the position of FIG. 3 (see travel of articulating projection 36), the air piston (not shown) is carried along by the slide cylinder 15 against the action of the pressure piston spring abutting on the jacketing cylinder 15 in the vicinity of the trigger system 16. The compression of the air piston spring is still further continued after the slide cylinder 15 has come home against the transport angle 13 and the jacketing cylinder 14 is moving forward. Before the barrel assembly 20 reaches the arrest position of FIG. 1, the air piston is retained in an arrest provided on the jacketing cylinder 14. The air piston can then return no farther forward, and the slide cylinder 15 stands still, being relieved of the action of the air spring, in the position shown in FIG. 4. In this position, the projectile can be introduced through the loading window of the jacketing cylinder 14 into the right-hand end of the barrel 12 fixedly connected to the jacketing cylinder 14. Then the cocking lever 30 can be swung counterclockwise and the slide cylinder 15 be pushed forward again into a position relative to the jacketing cylinder 14 as shown in FIG. 1. Thus the anterior end of the slide cylinder 15 arrives in sealing position against the sealing surface encircling the posterior end of the barrel. The space between the posterior end of the barrel and the air piston then forms a compression chamber. When the arrest of the air piston is released by actuation of the trigger system 16, the air piston, relieving the piston spring, moves forward and reduces the compression space, so that the increased pressure building up there will propel the projectile through the barrel 12.

It is to be noted that when the shot is fired, the trigger system 16 with jacketing cylinder 14 passes out of the position in FIG. 3 into the position in FIG. 1, i.e. is displaced backwards relative to the stock 26.

A low-recoil gun 10, in particular a compressed-air gun or hand firearm, has been proposed, comprising a stock assembly 25 and a barrel assembly 20 displaceable in lengthwise direction B of the gun 10 relative to the stock assembly. The barrel assembly 20, on the occasion of a discharge, can be moved out of a position of readiness to fire contrary to the direction of fire A. The reverse travel of the barrel assembly 20, due to the discharge, is restrained by an arrest means 40 capable of being overcome by the recoil energy of the barrel assembly 20. In overcoming the arresting means 40, the barrel assembly performs work, which is deducted from the recoil energy, so that the recoil ultimately transmitted to the gunner is at least substantially reduced.

What is claimed is:

1. Low-recoil gun, in particular a compressed-air gun or a firearm, comprising a stock assembly (25) and a barrel assembly (20) displaceable in longitudinal direction (B) of the gun relative to the stock assembly (25), the barrel assembly (20) being movable contrary to direction of fire (A), on the occasion of a discharge, out of a position of readiness to fire, and a movement of the barrel assembly (20) contrary to direction of fire (A) due to the discharge being restrained by a locking means (40) capable of being overcome by recoil energy of the barrel assembly (20), the locking means (40) comprising at least one snap-in element (46) in one (25) of the barrel assembly (20) and the stock assembly (25), a spring (42) exerting a biasing force on the snap-in element (46) urging the snap-in element (46) towards the other (20) of the barrel assembly (20) and the stock assembly (25), and a snap-in recess (44) on the other (20) of the barrel assembly (20) and the stock assembly (25) and having a disengaging surface or edge, the snap-in element (46) being disengageable from the snap-in recess (44) by the disengaging surface or edge against the biasing force of the spring (42) during movement of the barrel assembly (20) contrary to the direction of fire (A) in longitudinal direction of the barrel assembly (20), and adjustable support means (64) for the spring (42) being provided on the one (25) of the barrel assembly (20) and the stock assembly (25) for adjusting the biasing force of the spring (42) so as to adjust an axial force required in longitudinal direction of the barrel assembly (20) to overcome the locking means (40), in particular the initial axial force in longitudinal direction of the barrel assembly (20).

2. Low-recoil gun according to claim 1, wherein the adjustable support means (64) for adjusting the biasing force of the spring (42) is continuously adjustable.

3. Low-recoil gun according to claim 1, wherein the locking means (40) takes effect approximately at commencement of movement of the barrel assembly (20) contrary to the direction of fire (A) out of the position of readiness to fire.

4. Low recoil gun according to claim 3, wherein the locking means (40) takes effect immediately upon commencement of movement of the barrel assembly (20) contrary to the direction of fire (A) out of the position of readiness to fire.

5. Low-recoil gun according to claim 1, wherein the snap-in element (46) is on the stock assembly (25).

6. Low-recoil gun according to claim 1, wherein the snap-in element (46) is guided in the one (25) of the barrel assembly (20) and the stock assembly (25) on a disengagement path (62) having a directional component perpendicular to the longitudinal direction (B) of the gun.

7. Low-recoil gun according to claim 6, wherein the disengagement path (62) is substantially perpendicular to the barrel centerline (B).

8. Low-recoil gun according to claim 6, wherein the snap-in element **(46; 146; 346*a*, 346*b*) is disengageable downward, in terms of the shape of the gun, by the disengaging surface or edge (44; 144; 344*a*, 344*b*) in the course of movement of the barrel assembly (20; 120; 320)** contrary to the direction of fire (A).

9. Low-recoil gun according to claim 6, wherein the snap-in element **(446*a*, 446*b*) is disengageable laterally, in terms of the shape of the gun, by the disengaging surface (444*a*, 444*b*) in the course of movement of the barrel assembly (420)** contrary to the direction of fire (A).

10. Low-recoil gun according to claim 1, wherein the disengaging surface or edge (44) and an engagement surface of the snap-in element (46), cooperating with the disengaging surface or edge, are geometrically so coordinated with each other that a distance covered by the snap-in element (46) along a disengagement path (62) increases degressively with increasing distance covered by the barrel assembly (20) during movement contrary to the direction of fire (A).

11. Low-recoil gun according to claim 10, wherein the engagement surface of the snap-in element (46) has a substantially circular line of engagement.

12. Low-recoil gun according to claim 11, wherein the engagement surface of the snap-in element (46) is substantially spherical.

13. Low-recoil gun according to claim 11, wherein the disengagement path (62) is substantially perpendicular to the longitudinal direction (B) of the gun, and wherein the disengaging surface or edge (44) acts, at commencement of engaging with the circular line of engagement, at a point (P) of the line of engagement such that the line connecting it with the center of curvature (M) of the line of engagement includes an angle with the direction of the disengagement path (V) measuring between 30° and 80°.

14. Low-recoil gun according to claim 13, wherein the angle measures between 45° and 70°.

15. Low-recoil gun according to claim 1, wherein on the other (120) of the barrel assembly (120) and the stock assembly (125), an inclined ramp surface (152*a*) is provided, tilted relative to a plane determined by a longitudinal axis (B') and a transverse axis (Q) of the gun about the transverse axis (Q) by a predetermined angle ($\alpha$), the snap-in element (146) being increasingly disengageable against spring action by virtue of the inclined ramp (152*a*) during movement of the barrel assembly (120) contrary to the direction of fire (A).

16. Low-recoil gun according to claim 1, wherein a damping member (297) is provided adjacent an end of a path of movement of the barrel assembly (220) contrary to the direction of fire (A), for damping the movement of the barrel assembly (220) contrary to the direction of fire (A).

17. Low-recoil gun according to claim 1, wherein in addition to adjustability of the axial force required in longitudinal direction of the barrel assembly to overcome the locking means, mass of the snap-in element (46) or/and mass of parts connected to the snap-in element (46) for common motion is tuned to a desired recoil behavior of the gun.

18. Low-recoil gun according to claim 1, wherein the barrel assembly (20) is guided on the stock assembly (25) by a slide bearing guide (22, 24).

19. Low-recoil gun according to claim 18, wherein the slide bearing guide (22, 24) is configured in the manner of a three-point support, with a twin-bearing guide (24) and a single bearing guide (22) positioned at a distance therefrom in the longitudinal direction (B) of the gun.

20. Low-recoil gun according to claim 19, wherein a supplementary guidance (78/80) is provided adjacent the single bearing guide (22), for security against torsion.

21. Low-recoil gun according to claim 19, wherein the supplementary guidance (78/80) comprises balls (80) elastically prestressed against a guiding surface.

22. Low-recoil gun according to claim 19, wherein centerlines of all three bearings (48, 68) of the twin-bearing guide and the single-bearing guide lie substantially in one plane.

23. Low-recoil gun according to claim 19, wherein the twin-bearing guide (424) comprises a guide plate (499) guided in an undercut guide groove (498).

24. Low-recoil gun according to claim 18, wherein the locking means (40) is between a guide block (58) of the slide bearing guide (24) and a carrier (52) of a guide member (48) guiding the guide block (58).

25. Low-recoil gun according to claim 18, wherein the slide bearing guide is configured as a slide pin guide having a double-pin guide (24; 124) and a single-pin guide (22; 222; 322) at a distance therefrom in the longitudinal direction (B) of the gun.

26. Low-recoil gun according to claim 1, wherein the adjustable support means (64) is covered by means (92) for preventing unintentional misadjustment of the adjustable support means (64).

27. Low-recoil gun according to claim 1, wherein the adjustable support means (64) for the spring (42) is a screw (64) having an end face acting onto the spring (42).

28. Low-recoil gun according to claim 27, wherein the screw (64) has an external thread and is completely received in an internally threaded channel (62) of a bearing unit (22, 24) which permits relative displacement of the barrel assembly (20) and the stock assembly (25) in the longitudinal direction (B) of the gun.

29. Low-recoil gun according to claim 28, wherein the internally threaded channel (62) receives a fastening bolt (92) by which one of the barrel assembly (20) and the stock assembly (25) is fastened to the bearing unit (22, 24) and which prevents unintentional misadjustment of the screw (64).

30. Low-recoil gun, in particular a compressed air gun having a stock assembly (25) and a barrel assembly (20), wherein the barrel assembly (20) comprises a jacketing cylinder (14) fixedly connected to the barrel assembly, the jacketing cylinder being displaceable relative to the stock assembly between a position of readiness to fire (FIG. 3) and a home position (FIG. 1), wherein a slide cylinder (15) is displaceably guided in the jacketing cylinder (14), the slide cylinder (15) being retractable relative to the jacketing cylinder (14) into a loading position (FIG. 4) by means of a cocking lever (30) mounted on the jacketing cylinder (14) with the aid of a linkage (32), taking with it an air piston against the action of a piston spring abutting upon the jacketing cylinder (14), the air piston being arrestable in a barrel-far position of readiness to fire in relation to the jacketing cylinder (14), the slide cylinder (15) being thereupon returnable, leaving the air piston in the position of readiness to fire, into a sealing position in relation to the barrel (12) by means of the cocking lever, and arrest of the air piston being ultimately releasable by actuation of a trigger system (16) mounted on the jacketing cylinder (14), for firing a shot, in which the slide cylinder (15), in the course of backward motion for loading the piston spring, meets a stationary stop (38) on the stock assembly (25) before the cocking lever (30) has reached the end of its swing effecting the backward motion, and in which thereafter, by continued motion of the cocking lever (30) towards the end position, the jacketing cylinder (14) is displaceable relative to the stock assembly (25) and the slide cylinder (15) abutting on the stop (38) into the position of readiness to fire.

31. Low-recoil gun, in particular a compressed-air gun or a firearm, comprising a stock assembly (25) and a barrel assembly (20) displaceable in a longitudinal direction (B) of the gun relative to the stock assembly (25), the barrel assembly (20) being movable contrary to a direction of fire (A) on the occasion of a discharge, out of a position of readiness to fire, and a movement of the barrel assembly (20) contrary to the direction of fire (A) due to the discharge being restrained by locking means (40) capable of being overcome by recoil energy of the barrel assembly (20), the barrel assembly (20) being guided on the stock assembly (25) by a slide bearing guide (22, 24) configured as a three-point support, said slide bearing guide comprising a twin bearing guide (24) and a single bearing guide (22) spaced from each other in the longitudinal direction (B) of the gun.

32. Low-recoil gun according to claim 31, wherein a supplementary guidance (78/80) is provided adjacent the single bearing guide (22), for security against torsion.

33. Low-recoil gun according to claim 32, wherein the supplementary guidance (78/80) comprises balls (80) elastically prestressed against a guiding surface.

34. Low-recoil gun according to claim 31, wherein the locking means (40) is between a guide block (58) of the slide bearing guide (24) and a carrier (52) of a guide member (48) guiding the guide block (58).

35. Low-recoil gun according to claim 31, wherein centerlines of all three bearings (48, 68) of the twin-bearing guide and the single-bearing guide lie substantially in one plane.

36. Low-recoil gun according to claim 31, wherein the slide bearing guide (24) is configured as a slide pin guide having a double-pin guide (24; 124) and a single-pin guide (22; 222; 322) positioned at a distance from each other in the longitudinal direction (B) of the gun.

37. Low-recoil gun according to claim 31, wherein the twin-bearing guide comprises a guide plate (499) guided in an undercut guide groove (498).

38. Low-recoil gun, in particular a compressed-air gun or a firearm, comprising a stock assembly (25) and a barrel assembly (20) displaceable in longitudinal direction (B) of the gun relative to the stock assembly (25), the barrel assembly (20) being movable contrary to direction of fire (A), on the occasion of a discharge, out of a position of readiness to fire, and a movement of the barrel assembly (20) contrary to direction of fire (A) due to the discharge being restrained by a locking means (40) capable of being overcome by recoil energy of the barrel assembly (20), the barrel assembly (20) being guided on the stock assembly (25) by a slide bearing guide (22, 24), the slide bearing guide being configured as a slide pin guide having a double-pin guide (24; 124) and a single-pin guide (22; 222; 322) at a distance from each other in the longitudinal direction (B) of the gun.

* * * * *